US006317090B1

(12) United States Patent
Nagy et al.

(10) Patent No.: US 6,317,090 B1
(45) Date of Patent: Nov. 13, 2001

(54) AM/FM SOLAR-RAY ANTENNA WITH MIRROR WIRING GROUNDING STRAP

(75) Inventors: Louis Leonard Nagy; Douglas Courtney Martin, both of Warren, MI (US)

(73) Assignees: General Motors Corporation, Detroit; Delphi Technologies, Inc., Troy, both of MI (US)

( * ) Notice: Subject to any disclaimer, the term of this patent is extended or adjusted under 35 U.S.C. 154(b) by 0 days.

(21) Appl. No.: 09/630,953

(22) Filed: Aug. 3, 2000

(51) Int. Cl.[7] ..... H01Q 1/32
(52) U.S. Cl. ..... 343/713
(58) Field of Search ..... 343/713, 704; H01Q 1/32

(56) References Cited

U.S. PATENT DOCUMENTS

| | | | |
|---|---|---|---|
| 4,898,789 | 2/1990 | Finley | 428/623 |
| 5,528,314 | 6/1996 | Nagy et al. | 347/713 |
| 5,739,794 | 4/1998 | Nagy et al. | 343/713 |
| 6,020,855 | 2/2000 | Nagy et al. | 343/713 |
| 6,198,447 * | 3/2001 | Sauer | 343/713 |

* cited by examiner

*Primary Examiner*—Michael C. Wimer
(74) *Attorney, Agent, or Firm*—Christopher DeVries

(57) ABSTRACT

A solar-ray antenna that includes a tuning element asymmetrically positioned on the windshield of a vehicle a certain distance from a multi-wire bundle connected to a rear-view mirror of the vehicle. An impedance matching element of the antenna is spaced a certain distance from the vehicle body so as to provide proper impedance matching for the tuning element. The wire bundle extends through a channel that is mounted to an inside surface of the windshield. A grounding connector is positioned relative to the wire bundle and is coupled to ground so that FM signals in the wire bundle are coupled to ground. The grounding connector can be positioned over the wire bundle and attached to the vehicle roof sheet metal. In an alternate embodiment, the grounding connector is an L-shaped conductive frit formed on the windshield, and having a horizontal portion positioned between the glass and the urethane windshield seal and a vertical portion positioned between the channel and the windshield.

18 Claims, 5 Drawing Sheets

AM/FM SOLAR-RAY ANTENNA WITH MIRROR WIRING GROUNDING STRAP

BACKGROUND OF THE INVENTION

1. Field of the Invention

This invention relates generally to a vehicle antenna and, more particularly, to a solar-ray vehicle antenna provided in the windshield of a vehicle for AM/FM radio reception, that includes a mirror wiring ground strap.

2. Discussion of the Related Art

Most modern vehicles include a vehicle radio that requires an antenna system to receive amplitude modulation (AM) and frequency modulation (FM) broadcasts from various radio stations, Present day vehicle antenna systems may include a mast antenna that extends from a vehicle fender, vehicle roof, or some applicable location on the vehicle. Although mast antennas provide acceptable AM and FM reception, it has been recognized by vehicle manufacturers that the performance of a mast antenna cannot be significantly increased, and therefore, improvements obtained in other areas of in-vehicle entertainment systems will not include reception capabilities of the mast antenna. Consequently, vehicle manufacturers have sought other types of antenna designs to keep pace with consumer demands for increased vehicle stereo and radio capabilities.

Improvements in vehicle antenna systems have included the development of backlite antenna systems, where antenna elements are formed on a rear window of the vehicle in various designs. Backlite antenna systems have provided a number of other advantages over mast antenna systems, including no wind noise, reduced drag on the vehicle, elimination of corrosion of the antenna, no performance change with time, limited risk of vandalism, and reduced cost and installation.

A new concept for antenna systems provides an antenna between the inner and outer laminated glass sheets of a vehicle windshield. U.S. Pat. No. 5,528,314, titled "Transparent Vehicle Window Antenna" issued Jun. 18, 1996 and U.S. Pat. No. 5,739,794 titled "Vehicle Window Antenna With Parasitic Slot Transmission Line," issued Apr. 14, 1998, disclose "Solar-Ray" antennas of this type, and U.S. Pat. No. 6,020,855 transparent vehicle window antenna with capacitive connection apparatus, issued Feb. 1, 2000.

FIG. 1 is a diagrammatic view of a known Solar-Ray vehicle antenna 10 of the type disclosed in the above mentioned patents laminated in a windshield 12 of a vehicle, The windshield 12 will be mounted within an opening of a vehicle body that is made of an electrically conductive metal, such as steel or aluminum, by known window mounting techniques. The windshield 12 includes a dark tinted region 18 formed along a top border of the windshield 12 that reduces glare for the vehicle operator. The translucent nature of the tinted region 18 can be used to reduce the visibility of the antenna 10.

The antenna 10 is provided in the windshield 12 as a conductive film applied to the inner surface of an outer glass of the windshield 12 to be contained between outer and inner glass layers of the windshield 12. The film of the antenna 10 is essentially transparent to visible light, highly reflective of infrared radiation, electrically conducting, and preferably has a sheet resistance of 3 ohms per square or less. An example of a suitable film material is described in U.S. Pat. No. 4,898,789 to Finlay, issued Feb. 6, 1990. The film described herein can include a first anti-reflective metal oxide layer, such as oxide of zinc and tin, an infrared reflect,on metal layer, such as silver, a primer layer containing titanium, a second metal oxide layer, a second infrared reflective metal layer, such as silver, another primer layer, a third anti-reflective metal oxide layer, and an exterior protective layer of titanium metal or titanium oxide.

The antenna 10 includes two basic elements, a horizontally elongated tuning element 20 substantially parallel to and spaced from a top edge 22 of the windshield 12, and an impedance matching element 24. The tuning element 20 is essentially rectangular. although As horizontal edges may follow the curvature of the windshield edge 22 and its comers may be rounded for a more pleasing appearance. The tuning element 20 has an effective horizontal length of an odd integer multiple of one-quarter of the wavelength to which it is tuned, and thus exhibits a zero reactive impedance at the tuned wavelength. Different tuning element configurations can be provided in different designs.

In one embodiment, the tuning element 20 is tuned to a wavelength in the center of the FM frequency band (88 MHz–108 MHz), such as 3 meters, and thus has an effective horizontal length of about 0.75 meters. The physical length of the element 20 at resonance is actually somewhat shorter than one-quarter of the center frequency of the FM band to provide coupling to the vehicle body. The length by which the element 20 is shorter will vary with the specific vehicle application. In one particular vehicle, the tuning element 20 has been found to work well with a horizontal length of 60 cm and a vertical width of 50 mm. The element 20 is ideally spaced below the windshield edge 22 by a distance which provides maximum FM gain. However, this distance may be varied to provide other advantages for a particular vehicle design. The antenna 10 provides AM reception through capacitive coupling with the vehicle body.

The impedance element 24 includes a main body portion 28 which covers substantially all or most of the windshield 12 below the tinted region 18 to provide FM impedance matching. In the '794 patent, the impedance element can be a ribbon in various configurations to form a parasitic slot transmission line for FM impedance matching purposes. The main portion 28 has a peripheral edge 32 with a horizontal upper portion 34 spaced at least 25 mm below the lower edge of the element 20, so as to minimize transmission coupling effects therebetween. The upper portion 34 is connected to the element 20 by a narrow vertical portion 36 to provide an electrical current flow. The upper portion 34 of the peripheral edge 32 is preferably within the tinted region 18 of the windshield 12 along its entire length from one side to the other side of the windshield 12, so that the tinted region 18 overlaps the main portion 28 of the element 24. The remaining portion of the peripheral edge 32 is spaced a certain distance from the edge of the vehicle body so as to provide, in combination therewith, a planar slot transmission line that is parasitically coupled to the element 20. In one embodiment. the distance between the edge of the vehicle body and the main portion 28 is preferably within the 10–25 mm range. The length of the slot is substantially an integer multiple of one-half of the wavelength to which the tuning element 20 is tuned, so that each end of the slot transmission line, at the junctions of the upper portion 34 and the remaining portion of the peripheral edge 32, appears as an electrical open circuit.

The impedance element 24 is used to adjust the real component. of the antenna's impedance to match the characteristic impedance, typically 125 ohms, of the coaxial cable used to feed the antenna 10. This is accomplished by the predetermined width between the remaining portion of the peripheral edge 32 and the adjacent portion of the edge of the windshield. For appearance purposes, and to maximize the infrared reflecting efficiency of the windshield 12, an opaque painted band 40 may be provided around the sides and bottom of the windshield 12 to substantially or completely cover the area outward from the remainder portion of the peripheral edge 32 to the outer edge of the windshield 12. This band can be broken into dots of decreasing size towards the inner boundary for a fade-out effect, as known in the industry. If such a band is provided in combination with the tinted region 18, substantially the entire viewing area of the windshield 12 can be uniformly provided with the infrared reflecting film of the antenna 10.

The impedance element 24 also provides an added benefit at AM wavelengths. At these longer wavelengths, the antenna 10 is not a resonant antenna, but is substantially a capacitive antenna. The large area of the element 24 provides a substantial boost in gain for the antenna 10, as compared with similar planar and other antennas in the prior art. In fact, the boost in AM gain is so great that some of it can be sacrificed, if desired, in fine tuning the antenna performance for further improvements in FM gain, directional response, or other characteristics while still yielding good AM performance.

In order to connect the antenna 10 to a radio or other communications system, a connection arrangement is necessary for an external coaxial cable. An inner conductor 42 of a coaxial cable 44 is electrically connected to a planar capacitor grid feed 46 formed on an inside surface of the inner layer of the windshield 12. The capacitor grid feed 46 makes a capacitive feed connection to the tuning element 20 through the inner glass layer. An outer conductor of the coaxial cable 44 is connected to the vehicle body at a convenient point close to where the inner conductor 42 is coupled to the feed point. Any suitable feed connection can be provided between the capacitor grid feed 46 and the center conductor 42 of the coaxial cable 44 within the skill of the art.

The above described solar-ray antenna is currently being used in certain vehicles, and has been proposed to be used in certain future vehicles. However, for one of the proposed vehicles, two new electrical systems will be added to the vehicle that will have an adverse effect on the performance of the known solar-ray antenna. These two systems include a factory installed On-Star system and an interior rear-view mirror lighting system. These systems require a multi-wire bundle that extends down from the front center edge of the roof to the rear-view mirror that is attached to the windshield. In this configuration, the multi-wire bundle will travel directly across the upper part of the known solar-ray antenna and its feed system, affecting antenna reception. Particularly, the FM signals received by the antenna will RF couple to the wire grid bundle and adversely affect the antenna performance. The effects of this coupling may be different from vehicle to vehicle, depending on movement of the wire bundle relative to the antenna elements and the load on the wires in the bundle.

What is needed is a modified design of the known solar-ray antenna so that the multi-wire bundle will not interfere with the antenna reception. It is therefore an object of the present invention to provide such an improved solar-ray antenna.

SUMMARY OF THE INVENTION

In accordance with the teachings of the present invention, a modified solar-ray antenna is disclosed that includes a tuning element asymmetrically positioned on a windshield of a vehicle a certain distance from a multi-wire bundle connected to a rear-view mirror of the vehicle. In this position, the bundle does not cross any conductive portion of the antenna. An impedance matching element of the antenna is spaced a certain distance from the vehicle body so as to provide proper impedance matching for the tuning element. In one embodiment, the wire bundle extends through a channel that is mounted to an inside surface of the windshield. An Rt grounding connector is positioned relative to the wire bundle and is connected to ground so that FM signals in the wire bundle are coupled to ground. In one embodiment, the grounding connector is positioned over the wire bundle and is attached to the vehicle roof sheet metal. In an alternate embodiment, the grounding connector is an L-shaped conductive frit formed on the windshield, and has a horizontal portion positioned between the glass and a urethane windshield seal and a vertical portion positioned between the channel and the windshield.

Additional objects, advantages and features of the present invention will become apparent from the following description and appended claims taken in conjunction with the accompanying drawings.

DETAILED DESCRIPTION OF THE PREFERRED EMBODIMENTS

The following discussion of the preferred embodiments directed to a solar-ray antenna including an asymmetrically positioned tuning element and a grounding connector for a multi-wire bundle is merely exemplary in nature, and is in no way intended to limit the invention or its applications or uses.

Figure 1:
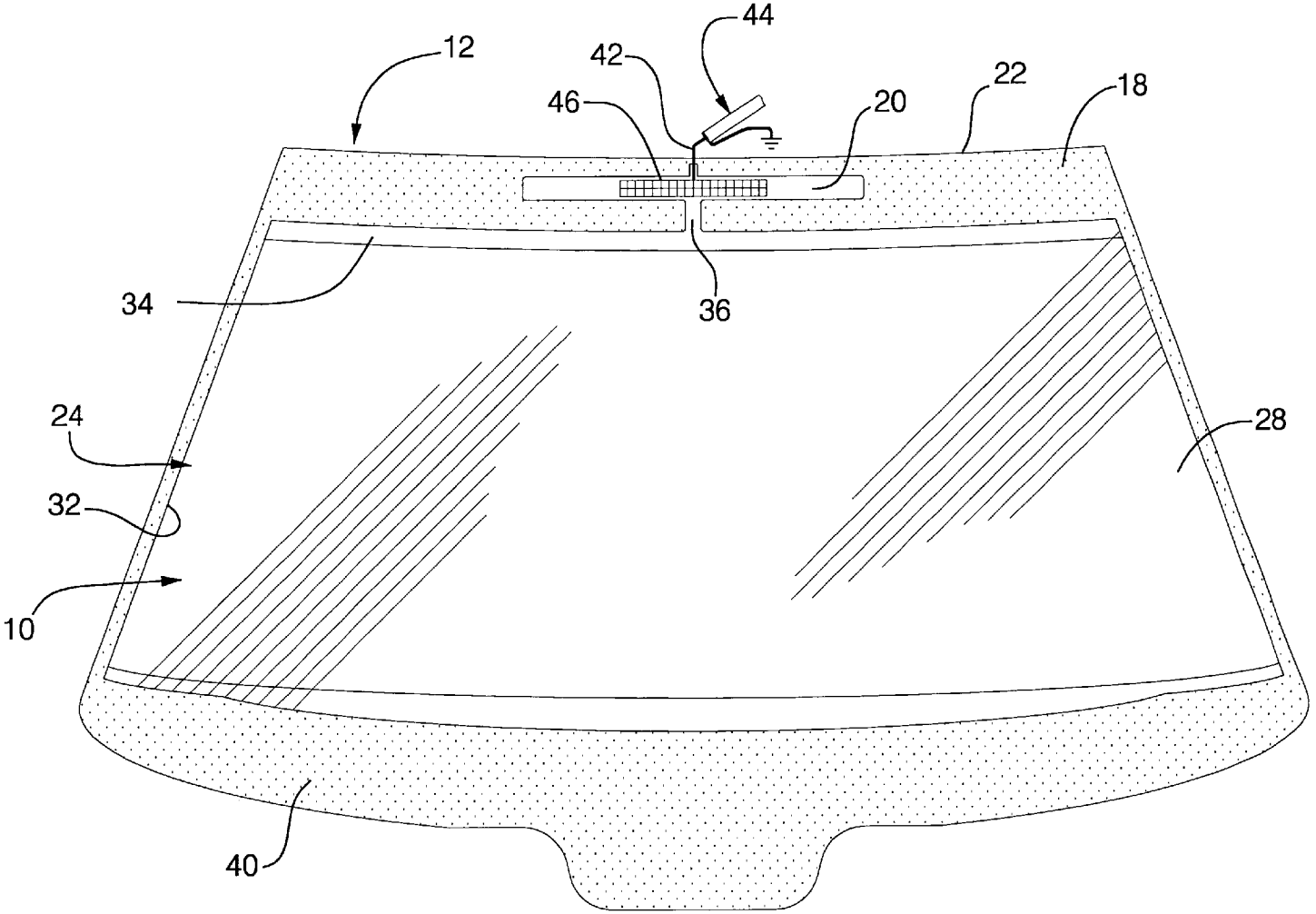
PRIOR ART FIG. 1
FIG. 1 is a diagrammatic view of a known solar-ray antenna.
Figure 2:
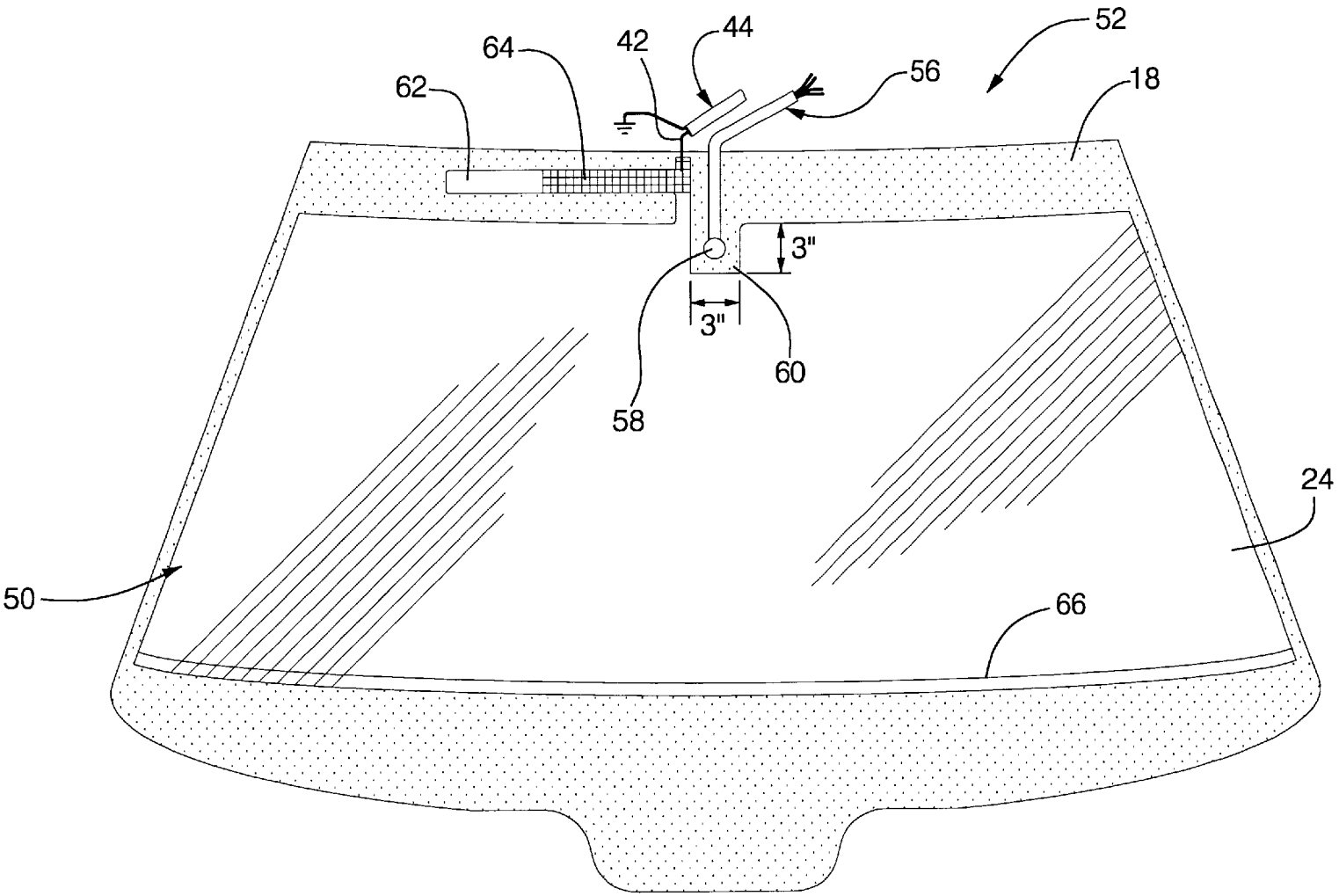
FIG. 2 is a diagrammatic view of a solar-ray antenna including a tuning element asymmetrically positioned a certain distance from a wire bundle located at a center portion of the vehicle windshield, according to an embodiment of the present invention.

FIG. 2 is a diagrammatic view of a solar-ray antenna 50 mounted in a vehicle windshield 52, according to an embodiment of the present invention. The antenna 50 and windshield 52 have similarities to the known solar-ray antenna 10 and the windshield 12 discussed above, and therefore like components are labeled with the same reference numeral. In this windshield design, a multi-wire bundle 56 extends from the roof of the vehicle and down the windshield 12 proximate to a rear-view mirror mounting bracket 58. The wire bundle 56 is connected to the rear-view mirror (not shown) that is mounted to the bracket 58 and provides control and power signals to certain vehicle systems, such as an On-Star system and rear-view mirror lighting systems. The wire bundle 56 may include a few or several wires depending on the is particular rear-view mirror design.

Because the wire bundle 56 is positioned at this central location, it would interfere with the capacitor feed 46 and the tuning element 20 of the antenna 10 and affect antenna performance. Therefore, according to the present invention, the tuning element 20 is replaced with a tuning element 62 positioned asymmetrically relative to the center of the windshield 52 some distance from the bundle 56. The tuning element 62 is electrically connected to the impedance element 24 by a narrowed portion 54. In this design, the wire bundle 56 extends down the windshield at a location where it does not cross any of the conductive portions of the antenna 50. A non-conductive windshield portion 60 is cut out of the impedance element 24 so that the wire bundle 56 is separated some distance from the conductive portions of the antenna 50, as shown. In one embodiment the conductive portions of the antenna 50 are at least one and one-half inches from the wire bundle 56. In this design, the portion 60 is three inches wide and three inches long to satisfy this requirement.

In one embodiment, the antenna element 62 is about sixteen inches in length about (⅛ the wavelength of the center of the FM frequency band) and is about two inches wide. A capacitor feed grid 64 replaces the capacitor feed grid 46 on the inside surface of the inner layer of the windshield 52 to provide the feed connection to the tuning element 62. In this design, the feed grid 64 is ten inches long and two inches wide.

The asymmetrical nature of the tuning element 62 relative to the windshield 52 generates different currents flowing through the conductive portions of the antenna 50, and thus alters its impedance from the known design. Therefore, the position of the impedance element 24 relative to the vehicle sheet metal needs to be changed to provide the desired impedance characteristics. Accordingly, in this design, the bottom edge 66 of the impedance element 24 is positioned about six inches away from the vehicle sheet metal.

This antenna design provides improved antenna reception characteristics in the presence of the Wire bundle 56. Table 1 below gives a comparison of the antenna reception characteristics of the various designs.

TABLE 1

| | Original design Without mirror wires | Original design With mirror wires | New design Without mirror wires | New design With mirror wires |
|---|---|---|---|---|
| | | FM GAIN | | |
| Frequency (MHz) | | | | |
| 89 | −2.3 | −4.9 | −1.2 | −2.8 |
| 95 | −7.4 | −12.8 | −4.4 | −6.3 |
| 107 | −8.2 | −8.7 | −4.4 | −4.5 |
| Av | −6.0 | −8.8 | −3.3 | −5.2 |
| | | AM GAIN | | |
| Frequency (kHz) | | | | |
| 560 | −7.1 | −7.0 | −10.1 | −9.2 |
| 760 | −11.0 | −10.9 | −5.7 | −4.3 |

TABLE 1-continued

| | Original design Without mirror wires | Original design With mirror wires | New design Without mirror wires | New design With mirror wires |
|---|---|---|---|---|
| 1600 | −6.5 | −6.6 | −4.9 | −3.9 |
| Av | −8.2 | −8.2 | −6.9 | −5.8 |

Figure 3:
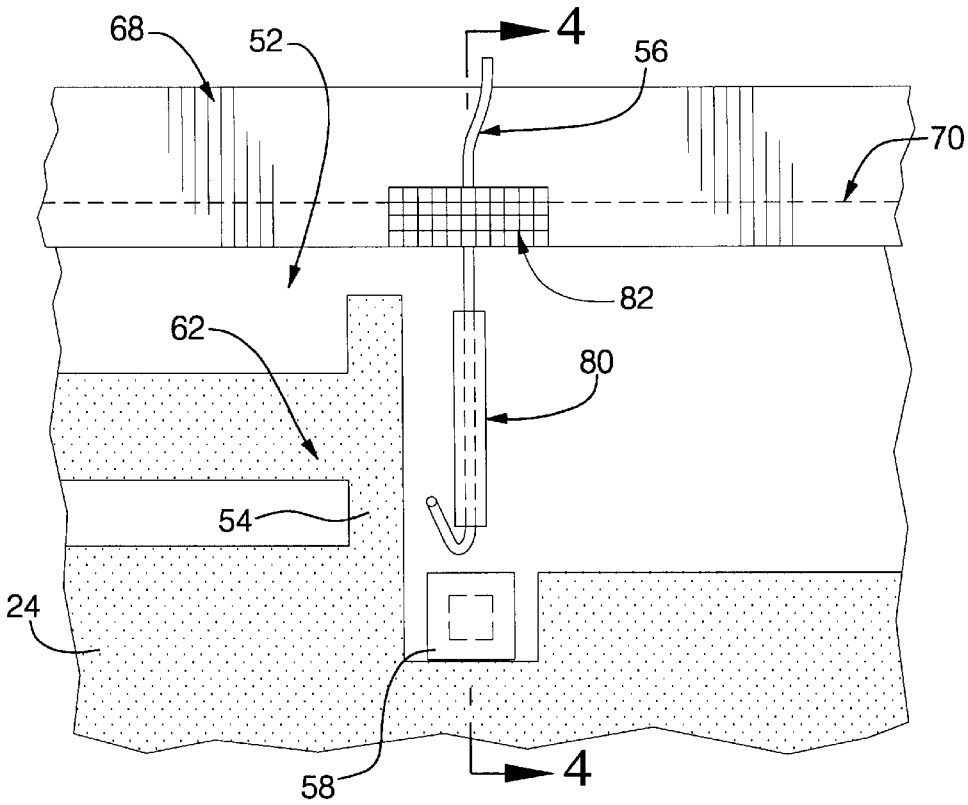
FIG. 3 is a broken-away diagrammatic view of the solar-ray antenna shown in FIG. 2 including a grounding strap positioned over the wire bundle and connected to ground, according to an embodiment of the present invention.
Figure 4:
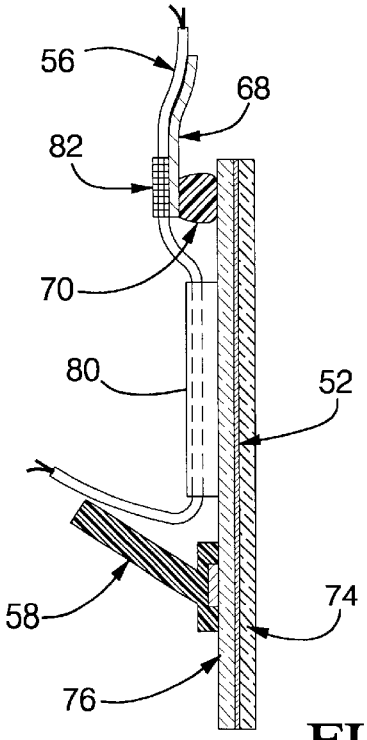
FIG. 4 is a cross-sectional view through line 4—4 of FIG. 3.

The measured data has demonstrated that the improved antenna characteristics can be degraded with the movement of the wire bundle 56 on the windshield 52 and the roof region, and with changes in the electrical modes in the wires. To minimize this degradation, certain changes can be made to the antenna 50. FIG. 3 is a broken-away view of the windshield 52 shown adjacent to the roof sheet metal 68 of the vehicle, and FIG. 4 is a cross-sectional view through line 4—4 in FIG. 3. A urethane seal 70 is shown between the roof sheet metal 68 and the windshield 52. In FIG. 4, the windshield 52 is shown including an outer glass layer 74 and an inner glass layer 76.

According to the invention, a plastic window channel 80 is mounted to the inner windshield layer 76 by a suitable glue or the like. The wire bundle 56 extends through the channel 80 so that it is secured to the windshield 52 at the desired location and is prevented from moving thereon. A metal grounding strap 82 is positioned over the wire bundle 56 and is connected to the roof metal 68. The grounding strap 82 acts as an FM low-pass filter to remove FM electro-magnetic energy from the bundle 56. FM signals on the wire bundle 56 are coupled to the roof metal 68 so that the wire bundle 56 in the windshield 52 acts like a grounded tuning element relative to the antenna 50. The antenna gain characteristics for this design are shown in Table 2 below.

TABLE 2

| | New design Roof ground strap Without mirror wires | New design Roof ground strap With mirror wires | New design WS ground ribbon Without mirror wires | New design Ws ground ribbon With mirror wires |
|---|---|---|---|---|
| | | FM GAIN | | |
| Frequency (MHz) | | | | |
| 89 | −1.2 | −1.0 | −1.0 | −2.0 |
| 95 | −4.4 | −6.8 | −5.8 | −8.0 |
| 107 | −4.4 | −4.1 | −6.3 | −6.1 |
| Av | −3.3 | −4.0 | −4.4 | −5.4 |
| | | AM GAIN | | |
| Frequency (kHz) | | | | |
| 560 | −10.1 | −10.5 | −9.9 | −9.9 |
| 760 | −5.7 | −8.0 | −6.3 | −6.3 |
| 1600 | −4.9 | −5.5 | −5.1 | −5.1 |
| Av | −6.9 | −7.3 | −7.1 | −7.1 |

Figure 5:
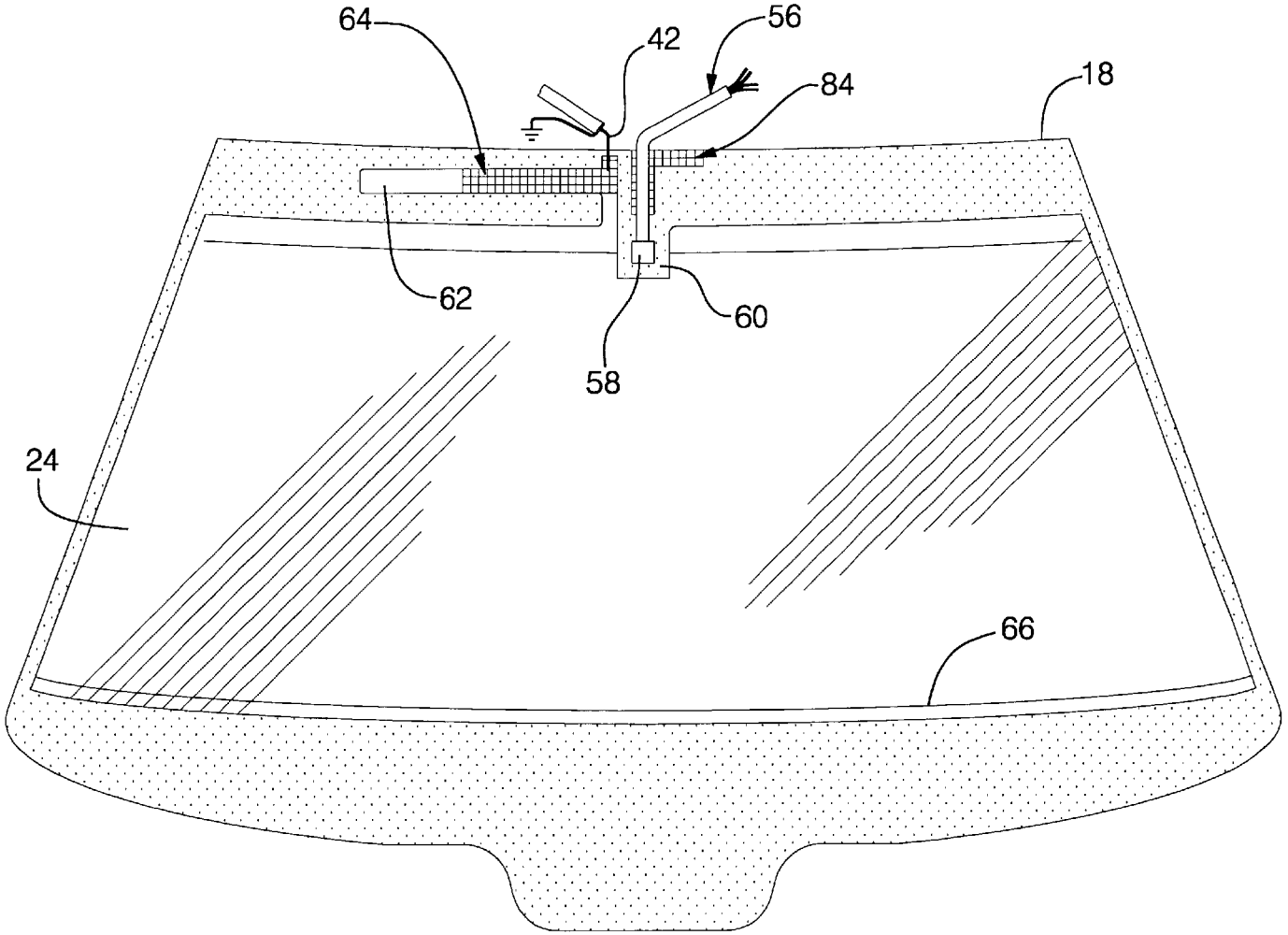
FIG. 5 is a diagrammatic view of a solar-ray antenna including an L-shaped grounding connector, according to another embodiment of the present invention.
Figure 6:
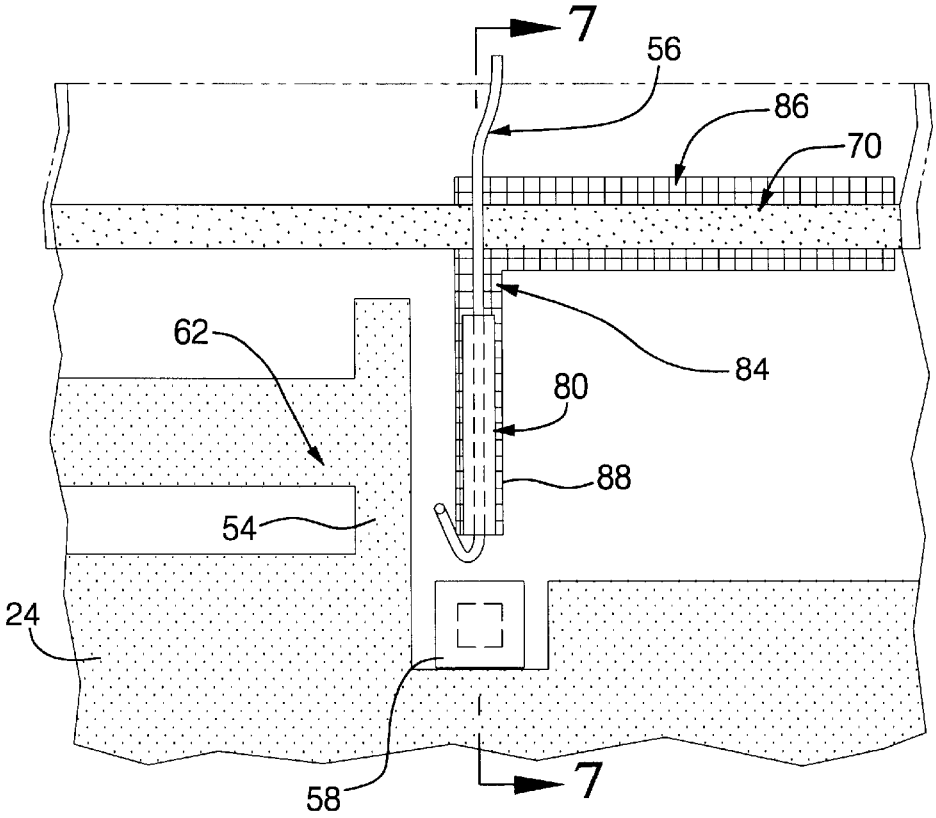
FIG. 6 is a broken-away view of the antenna shown in FIG. 5.
Figure 7:
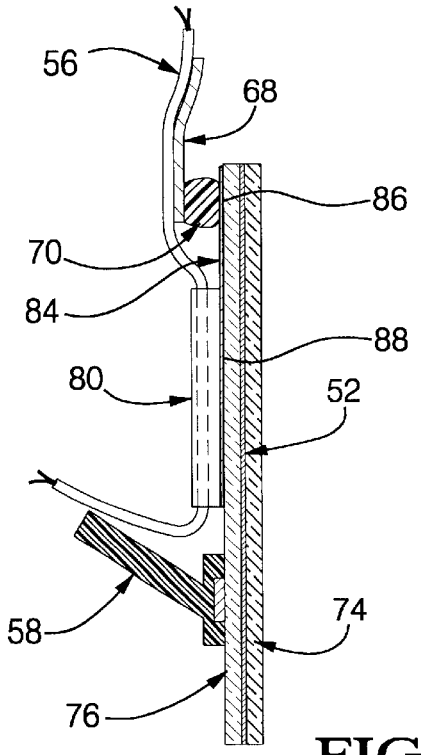
FIG. 7 is a cross-sectional view through line 7—7 of FIG. 6.

The grounding strap 82 provides the antenna performance desired, but its implementation and production may be difficult. Therefore, an alternate design has been devised that provides easier implementation. FIGS. 5–7 show different views of the windshield 52 where the grounding strap 82 has been replaced with an "L-shaped" grounding connector 84, The grounding connector 84 is formed as a conductive frit element on the inside surface of the inner layer 76, and can be formed at the same time the feed grid 64 is formed. The grounding connector 84 includes a horizontal element 86 and a vertical element 88. and is about one inch wide. The horizontal element 86 is formed between the urethane seal 70 and the inner layer 76. FM signals in the bundle 56 are coupled to the grounding connector 84 through the urethane seal 70 to the roof metal 68. The urethane seal 70 will ground the horizontal element 86 to the roof sheet metal 68. The vertical element 88 is located behind the wire channel 80, as shown. The vertical element 88 acts as a grounded antenna-tuning element and provides a capacitive low RF impedance path for any FM signals within the wire bundle 50.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A windshield assembly for a vehicle, said windshield assembly comprising:

a windshield including an outer glass layer and an inner glass layer;

a mirror fixture attached to an inside surface of the inner layer;

a wire bundle attached to the inside surface of the inner layer proximate the mirror fixture; and an antenna system mounted to the windshield, said antenna system including an elongated antenna tuning element disposed between the outer glass layer and the inner glass layer at an upper portion of the windshield, an impedance matching element disposed between the outer glass layer and the inner glass layer at a bottom portion of the windshield and being electrically connected to the elongated tuning element, and a capacitive feed mounted to the inside surface of the inner layer and being capacitively coupled to the elongated antenna element, said tuning element and capacitive feed being asymmetrically positioned relative to the windshield and being separated from the wire bundle.

2. The assembly according to claim 1 wherein the elongated tuning element is a rectangular tuning element about 16 inches long and about 2 inches wide.

3. The assembly according to claim 1 wherein the bottom portion of the impedance matching element is positioned about six inches from a vehicle sheet metal.

4. The assembly according to claim 1 wherein the wire bundle is positioned on the windshield so that it does not cross a conductive portion of the antenna system.

5. The assembly according to claim 1 wherein the antenna system includes a grounding connector positioned relative to the wire bundle, said grounding connector grounding FM signals in the wire bundle to vehicle ground.

6. The assembly according to claim 5 wherein the grounding connector is a metal piece positioned over the wire bundle and connected to an edge of a roof sheet metal.

7. The assembly according to claim 5 wherein the grounding connector is a conductive frit formed to the inside surface of the inner glass layer proximate the wire bundle.

8. The assembly according to claim 7 wherein the grounding connector includes a vertical portion positioned between the wire bundle and the inside glass layer and a horizontal portion positioned between a urethane seal and the inner layer.

9. The assembly according to claim 1 further comprising a channel member mounted to the inside surface of the inner layer, said wire bundle extending through the channel member.

10. A windshield assembly for a vehicle, said windshield assembly comprising:

a windshield including an outer glass layer and an inner glass layer;

a mirror fixture attached o an inside surface of the inner layer;

a wire bundle attached to the inside surface of the inner layer proximate the mirror fixture; and an antenna system mounted to the windshield, said antenna system including an elongated antenna tuning element disposed between the outer glass layer and the inner glass layer of an upper portion of the windshield, an impedance matching element disposed between the outer glass layer and the inner glass layer at a bottom portion of the windshield and being electrically connected to the elongated tuning element, and a capacitive feed mounted to the inside surface of the inner layer and being capacitively coupled to the elongated antenna element, said antenna system further including a grounding connector positioned relative to the wire bundle, said grounding connector grounding FM signals in the wire bundle.

11. The assembly according to claim 10 wherein the grounding connector is a metal piece positioned over the wire bundle and connected to an edge of a roof sheet metal.

12. The assembly according to claim 10 wherein the grounding connector is a conductive frit formed on the inside surface of the inner layer and positioned between the inner layer and the wire bundle.

13. The assembly according to claim 12 wherein the conductive frit is an L-shaped member having a vertical portion between the wire bundle and the inner glass layer and a horizontal portion between a polyurethane seal and the inner glass layer.

14. The assembly according to claim 10 further comprising a channel member mounted to the inside surface of the inner layer, said wire bundle extending through the channel member.

15. An antenna system for a vehicle, said antenna system including an electrically conducting structure formed on a vehicle window, said system comprising:

an elongated antenna tuning element formed at an upper location of the vehicle window and being asymmetrically positioned on the vehicle window;

an impedance matching element electrically connected to the tuning element by a narrowed conductive portion;

an antenna feed electrically connected to the tuning element; and a grounding connector positioned relative to a wire bundle mounted to the vehicle window and being separate from the tuning element, said grounding connector grounding FM signals in the wire bundle to vehicle ground.

16. The antenna system according to claim 15 wherein the grounding connector is a metal piece positioned over the wire bundle and connected to an edge of a roof sheet metal.

17. The antenna system according to claim 15 wherein the grounding connector is a conductive frit formed to an inside surface of an inner glass layer of the window proximate the wire bundle.

18. The antenna system according to claim 17 wherein the grounding connector includes a vertical portion positioned between the wire bundle and the inside glass layer and a horizontal portion positioned between a urethane seal and the inner layer.

* * * * *